US006328522B1

(12) United States Patent
Martz

(10) Patent No.: US 6,328,522 B1
(45) Date of Patent: Dec. 11, 2001

(54) METHOD AND APPARATUS FOR COLLECTING AND TRANSFERRING REFUSE

(76) Inventor: Erle Frederick Martz, #62 - 3730 Lansdown Avenue, Prince George, British Columbia (CA), V2N 2S5

( * ) Notice: Subject to any disclaimer, the term of this patent is extended or adjusted under 35 U.S.C. 154(b) by 0 days.

(21) Appl. No.: 09/437,750

(22) Filed: Nov. 10, 1999

(51) Int. Cl.[7] ..... B65F 1/12

(52) U.S. Cl. ..... 414/414; 414/328; 414/397; 414/399; 414/422; 414/809; 414/810

(58) Field of Search ..... 414/303, 328, 414/332, 389, 397, 399, 406, 414, 422, 595, 616, 808, 809, 810; 222/181.1

(56) References Cited

U.S. PATENT DOCUMENTS

| | | | | |
|---|---|---|---|---|
| 1,520,538 | * | 12/1924 | Dodge | 414/422 |
| 3,753,506 | * | 8/1973 | Palmer et al. | 414/332 |
| 4,200,422 | * | 4/1980 | Stodt | 414/414 |
| 4,249,848 | * | 2/1981 | Griffin et al. | 414/595 |
| 4,859,135 | * | 8/1989 | Neufeldt | 414/399 |
| 5,236,261 | * | 8/1993 | Hagenbuch | 414/397 |
| 6,077,020 | * | 6/2000 | Neufeldt et al. | 414/399 |
| 6,106,211 | * | 8/2000 | Westwood | 414/332 |

FOREIGN PATENT DOCUMENTS

| | | | | |
|---|---|---|---|---|
| 1132329 | | 9/1982 | (CA) | |
| 880893 | * | 11/1981 | (RU) | 414/389 |
| 1219480 | * | 3/1986 | (RU) | 414/397 |
| 1258773 | * | 9/1986 | (RU) | 414/397 |

* cited by examiner

*Primary Examiner*—James W. Keenan
(74) *Attorney, Agent, or Firm*—Oyen Wiggs Green & Mutala

(57) ABSTRACT

A method and apparatus for collecting and transferring refuse to a transportation truck for hauling to its ultimate disposal site, such as a landfill. The apparatus comprises a refuse collection and transfer container movable between a first, lowered position and a second, raised position. When the container is in the raised position and the transportation truck is underneath, transfer of the collected refuse is accomplished by opening angled, retractable bottom doors on the container. The bottom doors allow for the regulation of the amount of refuse transferred to the truck, thus ensuring a full load within the truck while at the same time preventing spillage. The movement of the container and the doors may be powered by the hydraulic system of the truck and controlled by a control panel on the apparatus. The apparatus may be partially below ground level.

16 Claims, 7 Drawing Sheets

METHOD AND APPARATUS FOR COLLECTING AND TRANSFERRING REFUSE

TECHNICAL FIELD

This invention pertains to a method and apparatus for collecting and transferring refuse to a transportation truck for hauling to its ultimate disposal site.

BACKGROUND

One of the challenges facing every community is the collection and disposal of refuse, such as household and commercial garbage. Generally, the refuse is ultimately disposed of at a permanent, sanitary landfill location, although certain types of garbage may be incinerated. It is desirable to provide for methods and systems that tidily, efficiently and economically collect and transport the refuse to the ultimate disposal site.

In densely populated urban areas, relatively small collection vehicles have traditionally collected refuse from individual house-holds and dwelling-places and directly transported the collected refuse to a nearby landfill site. This is economically inefficient because of the relatively small capacity of the collection vehicles, resulting in a relatively high cost of transporting a given weight of refuse.

Remote rural communities face added challenges because they are typically nowhere near a landfill site. Accordingly, it is often necessary for these communities to transport their collected refuse to far-away landfill sites. In order to maximize the cost efficiency of this added burden, the refuse transportation is often done via large transportation trucks which have a much greater capacity than the aforementioned collection vehicles. It is thus important to provide a location in or around remote communities where refuse can be collected, temporarily stored and ultimately transferred to the large trucks for its ultimate haul to a landfill site.

It has proven difficult to address these challenges in an effective manner. Canadian Patent No. 1,132,329, issued Sep. 28, 1982 to Neufeldt, represents one attempt. Neufeldt discloses a refuse disposal method and apparatus which utilizes a transfer container adapted to receive refuse from collection vehicles and discharge the refuse into larger transportation vehicles. Neufeldt accomplishes this by providing the transfer container mounted alongside a steep embankment so that the collection vehicles can approach same via a gentle ramp and backfill the hopper portion of the container. Ultimately, Neufeldt's container is pivoted, resulting in a "tilted" dumping of the refuse into a transportation vehicle located below the container and adjacent the steep embankment.

Neufeldt, however, has inherent disadvantages. First, the physical landscape required to accommodate the container assembly is impractical. Naturally-occurring locations offering a steep embankment of such a height and configuration to accommodate the Neufeldt assembly are rare. Accordingly, it will usually be necessary to construct a steep embankment through piling and shaping dirt, gravel or the like to a suitable height and providing suitable roads to accommodate the collection and transportation vehicles. Not only is this process extremely expensive, but it is also environmentally-unfriendly since it will be very difficult to reclaim the site should the collection container be moved in the future.

Second, Neufeldt does not offer the users the ability to regulate the amount of refuse "dumped" from the container to the transportation truck. Instead, the container is simply "tilted", thereby dumping the entirety of its contents. This is acceptable for transportation trucks which have the capacity for all of the collected refuse. However, transportation trucks may arrive at a particular remote community partially full because the same truck services numerous communities in the same trip. Thus, if a transportation truck already contains sufficient refuse so that it cannot accept the entirety of the contents of the Neufeldt container, the user is faced with one of two undesirable choices. First, he can bypass accepting the refuse at that time and simply collect it on another trip. This is disadvantageous because: (a) the transportation vehicle would be returning with less than 100% capacity, thus descreasing the cost-effectiveness of the operation; and (b) the remote community may not have the capacity to store the collected refuse while awaiting a second trip sometime later. The alternative to refusing to accept the refuse is to simply dump the container and let the excess spill over the top of the transportation vehicle. This is obviously disadvantageous since the spillage would require clean-up, or if it were not cleaned up, would be unsightly and would produce unpleasant odours and attract scavenging animals.

Accordingly, the present invention provides an efficient, cost-effective and self-contained apparatus and a method that allows a user to regulate the amount of collected refuse transferred to a transportation vehicle in any given dump.

SUMMARY OF INVENTION

The apparatus of the present invention comprises an apparatus for collecting and transferring refuse to a transportation truck, the apparatus comprising a refuse collection and transfer container movable between a first, lowered position and a second, raised position, the second position being high enough above the first position to allow the transportation truck underneath the refuse collection and transfer container, the refuse collection and transfer container having bottom doors wherein when the refuse collection and transfer container is in the second position and the bottom doors are opened the refuse is transferred from the refuse collection and transfer container to the transportation truck.

The bottom doors may be two doors, each being downwardly and inwardly angled from opposite side walls of the refuse collection and transfer container so that the bottom doors converge at the bottom of the refuse collection and transfer container forming a closed position, the bottom doors extending substantially the length of the side walls of the refuse collection and transfer container. The bottom doors may be retractable to an open position from the closed position through slots in the side walls of the refuse transfer and collection container. The bottom doors may be linked to a hydraulic system of the transportation truck, the movement of the bottom doors between the open and closed positions being powered by the hydraulic system.

The apparatus may also comprise four upright beams positioned proximate to the exterior corners of the refuse collection and transfer container, each of the upright beams including a cable movable relative to the beam; and at least two container braces connecting the refuse collection and transfer container to the cables. Vertical movement of the cables causes the movement of the refuse collection and transfer container between the first and second positions. The cables may be linked to the hydraulic system, the movement of the cables being powered by the hydraulic system.

It may also be that when the refuse collection and transfer container is in the first position a lower portion of the refuse collection and transfer container, including the slots in the side walls, is below ground level. The apparatus may further comprise two retaining walls, the retaining walls being substantially below ground level, adjacent to the refuse collection and transfer container and extending the length of the refuse collection and transfer container. The retaining wall may extend past the upright beams and adjacent to a sloped entrance for accepting the transportation truck at one end of said refuse collection and transfer container and a sloped exit for allowing the transportation truck to exit at a second end of the refuse collection and transfer container.

The bottom interior corners of the container may be downwardly and inwardly angled. The container may have at least one door for receiving the refuse, the door being in one of the side walls or in the roof of the collection and transfer container. The apparatus may also comprise a control panel for controlling the movement of the bottom doors and the cables, the control panel being linked to the bottom doors, the cables and capable of being linked to the hydraulic system.

The apparatus of the present invention may comprise at least two cylinders, each of the at least two cylinders being positioned underneath opposite side walls of the refuse collection and transfer container and being vertically movable to cause the movement of the refuse collection and transfer container between the first and second positions, wherein when the refuse collection and transfer container is in the second position, the at least two cylinders are spaced apart by a distance greater than the width of the transportation truck. The vertical movement of the may be driven by an electric power source internal to said apparatus.

The method of the present invention comprises the method of collecting and transferring refuse to a transportation truck, the method comprising the steps of: (a) providing an apparatus for collecting and transferring refuse to a transportation truck, the apparatus comprising a refuse collection and transfer container movable between a first, lowered position and a second, raised position, the second position being high enough above the first position to allow the transportation truck underneath the refuse collection and transfer container, the refuse collection and transfer container having bottom doors and at least one door for receiving the refuse, the door being in one of two opposite side walls or in the roof of the refuse collection and transfer container; (b) collecting refuse in the refuse collection and transfer container when the container is in the first position; (c) raising the refuse collection and transfer container to the second position; (d) driving the transportation truck underneath the raised refuse collection and transfer container; (e) opening the bottom doors of the refuse collection and transfer container so that the refuse collected in the refuse collection and transfer container is transferred to the transportation truck; (f) closing the bottom doors after at least some of the refuse has been transferred to the transportation truck; (g) driving the transportation truck from underneath the raised refuse collection and transfer container; and (h) lowering the refuse collection and transfer container to the first position.

The apparatus of the method of the present invention may further comprise four upright beams positioned proximate to the exterior corners of the refuse collection and transfer container, each of the upright beams including a cable movable relative to said beam; at least two container braces connecting the refuse collection and transfer container to the cables; and a control panel linked to said cables and said bottom doors and capable of being linked to a hydraulic system of said transportation truck. Step (c) of the method of the present invention may comprise (i) driving the transportation truck to a location proximate to the apparatus; (ii) establishing a linkage between the hydraulic system, the cables and the control panel when the refuse collection and transfer container is in the first position; and (iii) using the control panel to move the cables with the hydraulic system to raise the refuse collection and transfer container to the second position.

Step (e) of the method of the present invention may comprise: (i) establishing a linkage between the hydraulic system, the bottom doors and the control panel; and (ii) using the control panel to open the bottom doors with the hydraulic system so that the refuse collected in the refuse collection and transfer container is transferred to the transportation truck.

Step (f) of the method of the present invention may comprise using the control panel to close the bottom doors with the hydraulic system.

Step (g) of the method of the present invention may comprise: (i) disconnecting the linkage between the hydraulic system and the bottom doors; and (ii) exiting the transportation truck from underneath the raised refuse collection and transfer container.

Step (h) of the present invention may comprise: (i) driving the transportation truck to a location proximate to the apparatus; (ii) establishing a linkage between the hydraulic system, the cables and the control panel when the refuse collection and transfer container is in the second position; and (iii) using the control panel to move the cables with the hydraulic system to lower the refuse collection and transfer container to the first position; and (iv) disconnecting the linkage between the hydraulic system, the cables and the control panel.

BRIEF DESCRIPTION OF DRAWINGS

In the drawings which illustrate specific embodiments of the invention, but which should not be construed as restricting the spirit or scope of the invention in any way.

DESCRIPTION

Figure 1:
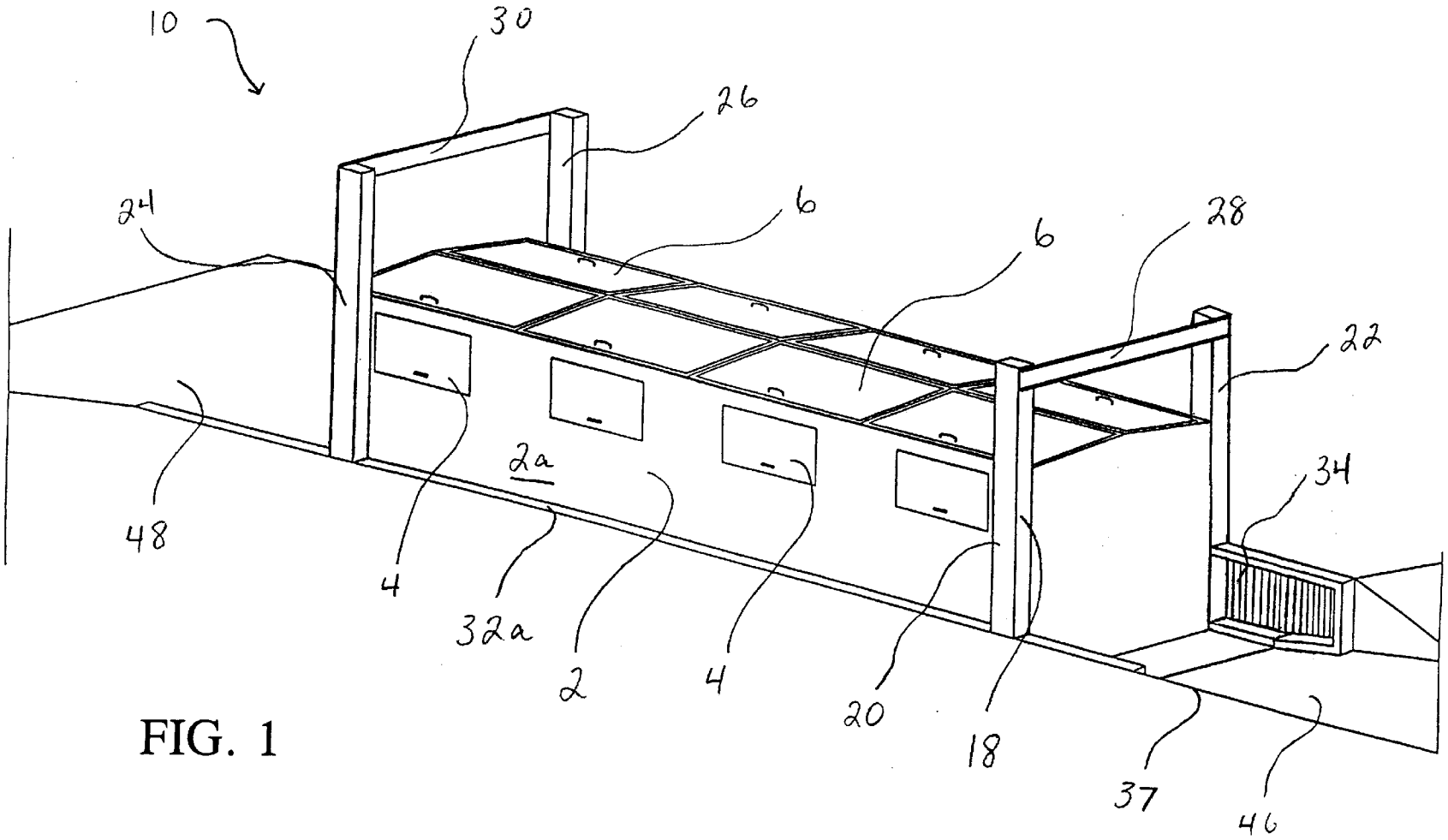
FIG. 1 is a side perspective view of a refuse collection and transfer apparatus made in accordance with one embodiment of the present invention.

Referring to FIG. 1, in a preferred embodiment, refuse collection and transfer apparatus 10 comprises refuse collection and transfer container 2 and lifting and retaining structure 18.

Figure 2:
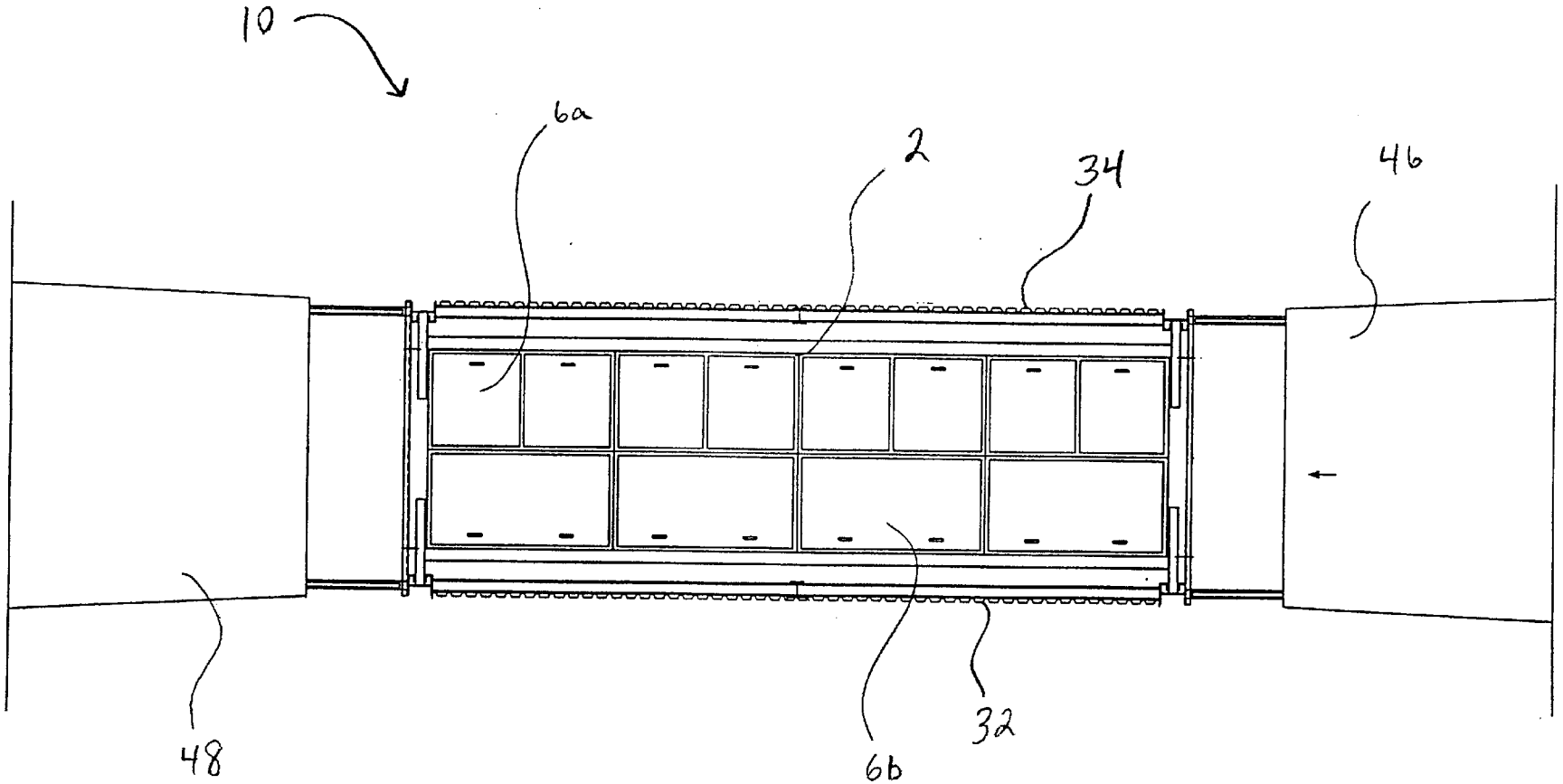
FIG. 2 is a top plan view of an alternative embodiment of the apparatus of FIG. 1.

Refuse collection and transfer container 2 is fashioned to receive and store household, commercial and/or industrial refuse while awaiting transfer to a hauling transportation truck. Referring to FIGS. 1 and 2, container 2 has side doors 4 through which household refuse may be deposited. Doors 4 are at a convenient elevation for individuals to discard their refuse by hand. Container 2 also has a plurality of top doors 6 which are somewhat larger than side doors 4 and which are provided to receive commercial/industrial refuse through back-dumping from a typical refuse collection vehicle. Top doors 6 may be arranged so as to require a hydraulic linkage for opening, thereby preventing the unauthorized and illegal dumping of large-scale waste by other than licensed refuse collectors.

It will be appreciated that many different combinations and arrangements of doors 4, 6 are possible within container 2. For example, FIG. 2 illustrates an alternative embodiment of the container of FIG. 1 wherein there are two different sizes 6*a,* 6*b* of top doors 6. Alternatively, "open" spaces could be provided in the places of either or both of doors 4, 6. Such arrangements would facilitate the disposal of refuse into container 2, but would also render the contents of container 2 susceptible to weather damage and would leave it open to scavenging animals. Generally, it is advantageous to maintain container 2 as closed a container as possible so as to prevent the escape of odours and the scavenging animals. This is particularly important in remote rural areas where animals such as bears and raccoons are easily drawn to human refuse in search of food.

Turning to FIGS. 5–10, it will be seen that container 2 has within it sloped pieces 8, each fitted into one of the four bottom corners (only two of which are illustrated in FIGS. 5–10) of container 2. Container 2 also has retractable bottom doors 14, 16. The function of sloped pieces 8 and bottom doors 14, 16 will be described below in greater detail.

Figure 3:
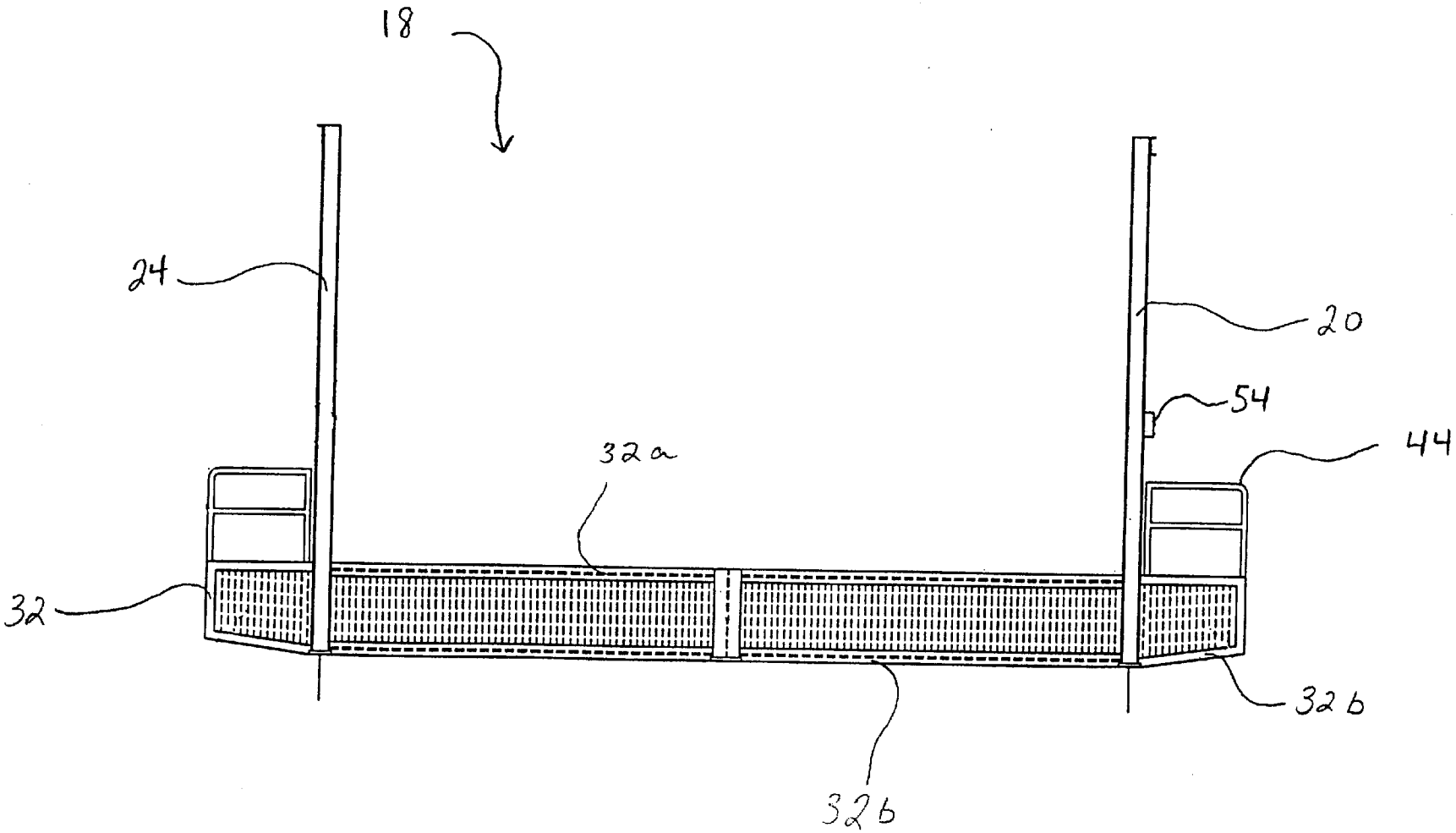
FIG. 3 is a side perspective view of the lifting and retaining structure of the apparatus of FIG. 1.

As illustrated in FIGS. 1 and 3, lifting and retaining structure 18 is formed by upright beams 20, 22, 24 and 26, beam support members 28, 30 and retaining walls 32, 34. Retaining walls 32, 34 extend the length of structure 18 past beams 20, 24 and 22, 26. Bottom bars 32*b* and 34*b* are angled slightly upwardly at their ends (i.e. past beams 20, 22, 24 and 26) to accommodate a downwardly sloped entrance 46 and an upwardly sloped exit 48 (see FIG. 4) for transportation truck 42. Safety railings 44 may be provided on top of the ends of top bars 32*a,* 34*a*. For strength and durability, the components of lifting and retaining structure 18 are preferably constructed of steel.

To construct refuse collection and transfer apparatus 10, a suitable grade of earth is plowed. Lifting and retaining structure 18 is placed therein so that top bars 32*a* and 34*a* (which is not seen in FIG. 3) of retaining walls 32, 34 are approximately even with ground level (see FIG. 1). Prepoured concrete foundation pads 36 provide stable anchor points to maintain lifting and retaining structure 18 in position. Appropriate bolts 38, which bolt into pads 36, ensure that structure 18 is securely positioned. The native soil, dug up to create the location for structure 18, is utilized to "fill in" around the lower portions of structure 18 after its placement. The soil, along with top gravel layer 40 (see FIGS. 5 and 6), which is added on top, is compacted to ensure that refuse collection and transfer apparatus 10 is secure and to support the weight of transportation truck 42. Since this soil is utilized in close proximity to apparatus 10, reclamation of the site is readily accomplished if it is necessary at some time in the future to relocate apparatus 10.

Walls 32 and 34 of structure 18 thus act to retain the soil adjacent to the lower portion of refuse collection and transfer apparatus 10 so that container 2 remains stable within structure 18.

Figure 4:
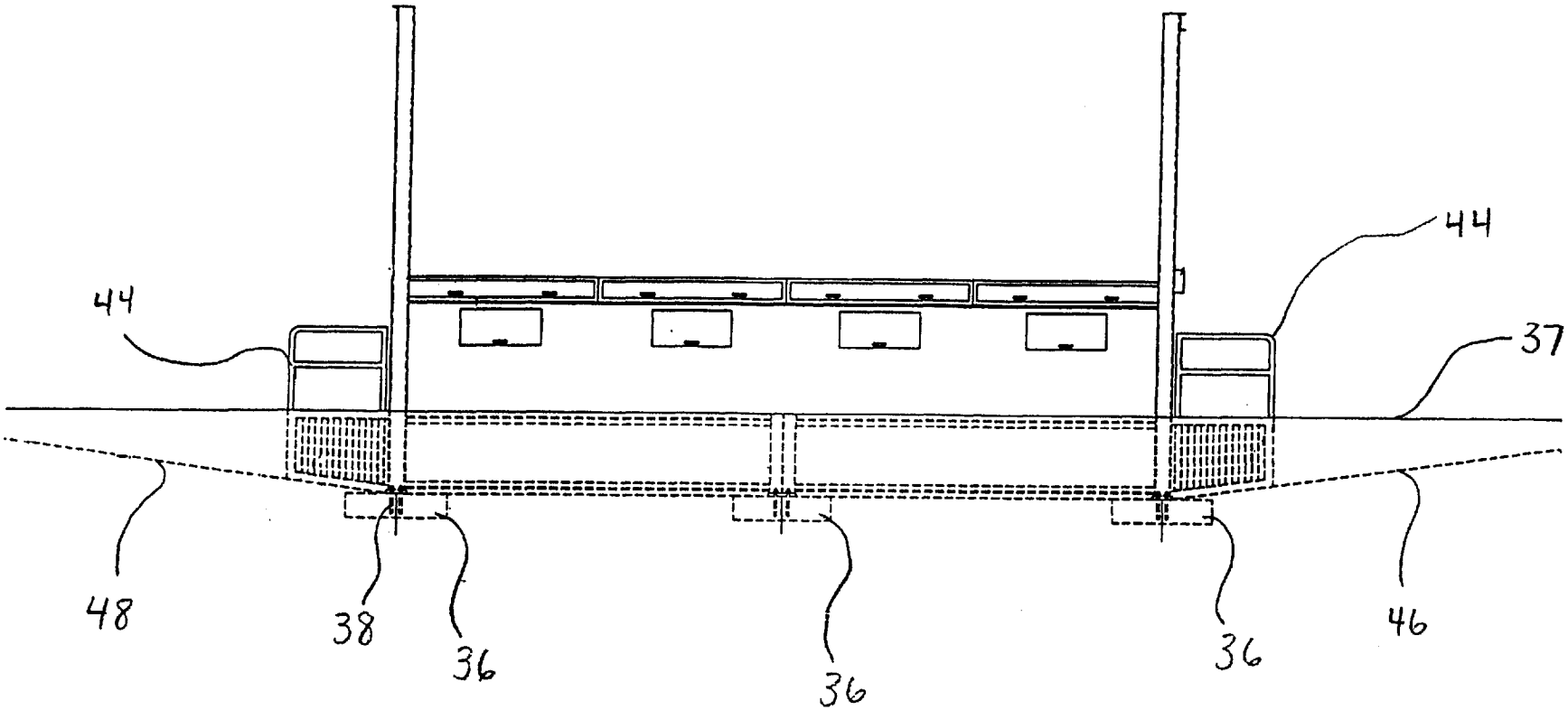
FIG. 4 is a side perspective view of the apparatus of FIG. 1 illustrating the below-ground level portion of the apparatus in dotted outline.
Figure 6:
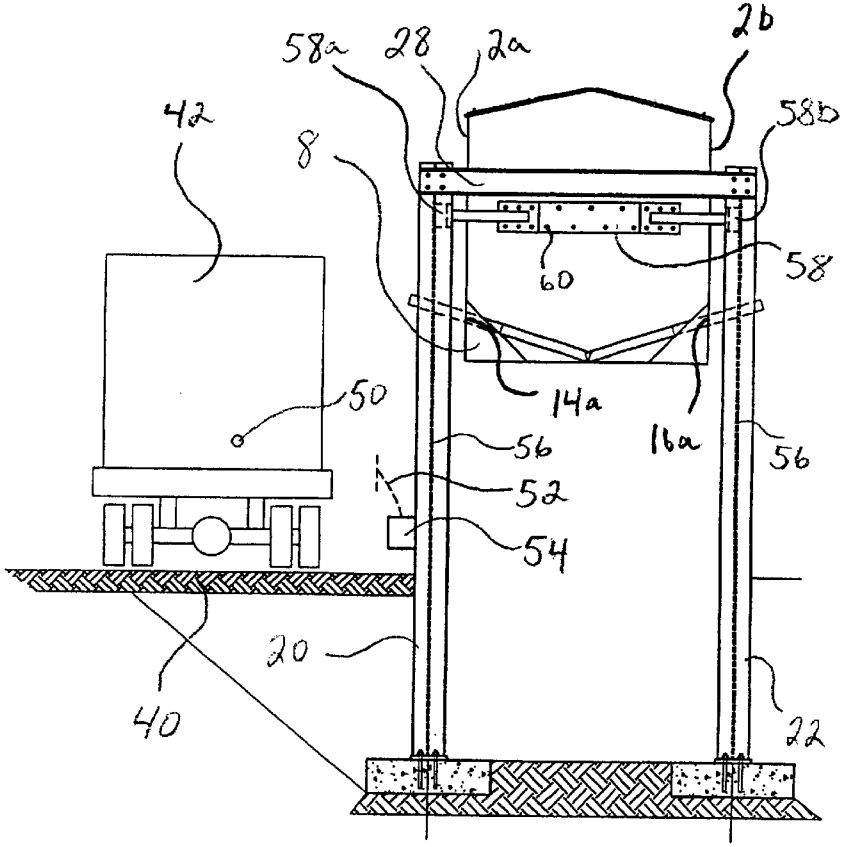
FIGS. 5–10 are end views of the apparatus of FIG. 1 illustrating the sequence of transferring collected refuse from the refuse collection and transfer container to a transportation truck.

Refuse collection and transfer container 2 is designed to fit within lifting and retaining structure 18. When container 2 is in its usual position, as illustrated in FIGS. 1 and 4, it is partially below ground level 37, but has a portion high enough above ground level 37 so that side doors 4 and top doors 6 are easily accessible for users to dispose of household or industrial garbage.

The method of operation of apparatus 10 to transfer refuse from container 2 to transportation truck 42 is illustrated in FIGS. 5–10. Between emptyings, container 2 sits within structure 18, collecting refuse. Periodically, empty truck 42 (FIG. 5) arrives at apparatus 10 to empty it. Truck 42 must first raise container 2 to the elevated position illustrated in FIG. 7. This is accomplished through a standard hydraulic system 50 on truck 42 and its linkage 52 with a control panel 54, which is connected to lifting and retaining structure 18.

Control panel 54 is connected via standard hydraulic lines (not shown) to cables 56 which pull container 2 up beams 20, 22, 24 and 26. Cables 56 run along beams 20, 22, 24 and 26 and are movable in relation thereto. Container 2 is connected to cables 56 by container braces 58 (not shown in FIG. 1, but see FIGS. 5–10). Although container brace 58 is shown to be secured to container 2 through traditional bolts 60, it will be appreciated that any suitable attachment means will suffice. The extremities 58*a* and 58*b* of container brace 58 are attached to cables 56. Although not illustrated in FIGS. 5–10, there is a second brace at the opposite end of container 2.

Returning to FIG. 5, linkage 52 between truck hydraulic system 50 and control panel 54 is established to raise container 2. Once container 2 is lifted, an appropriate locking mechanism (not shown) is activated to hold container 2 in its raised position. Linkage 52 is then disconnected (FIG. 6) and truck 42 can be driven down sloped entrance 46 and under raised container 2. At this point, a hydraulic linkage 52 is re-established (FIG. 7), and a signal sent to control panel 54 causing bottom doors 14 and 16 of container 2 to be retracted (FIG. 8), thereby dumping, or transferring, collected refuse 62 into truck 42 (FIG. 9). Sloped pieces 8 operate to prevent refuse 62 from getting lodged in the interior corners of container 8. This prevents blockage during dumping and thus facilitates the efficiency of apparatus 10.

Figure 5:
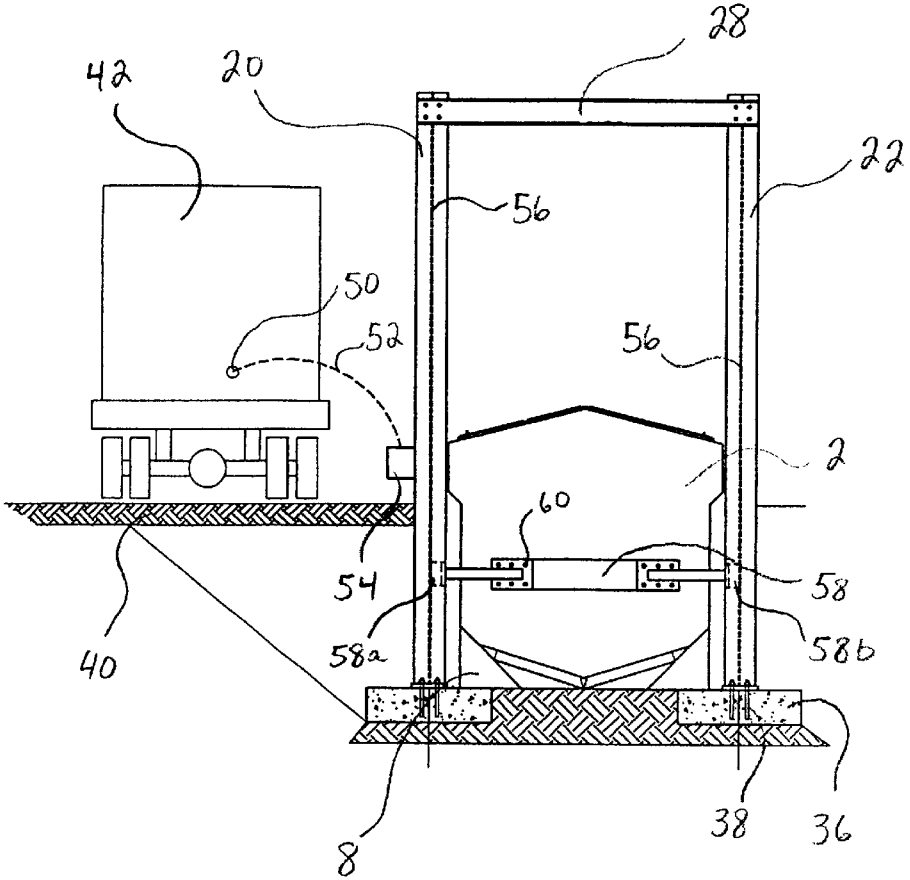
Figure 8:
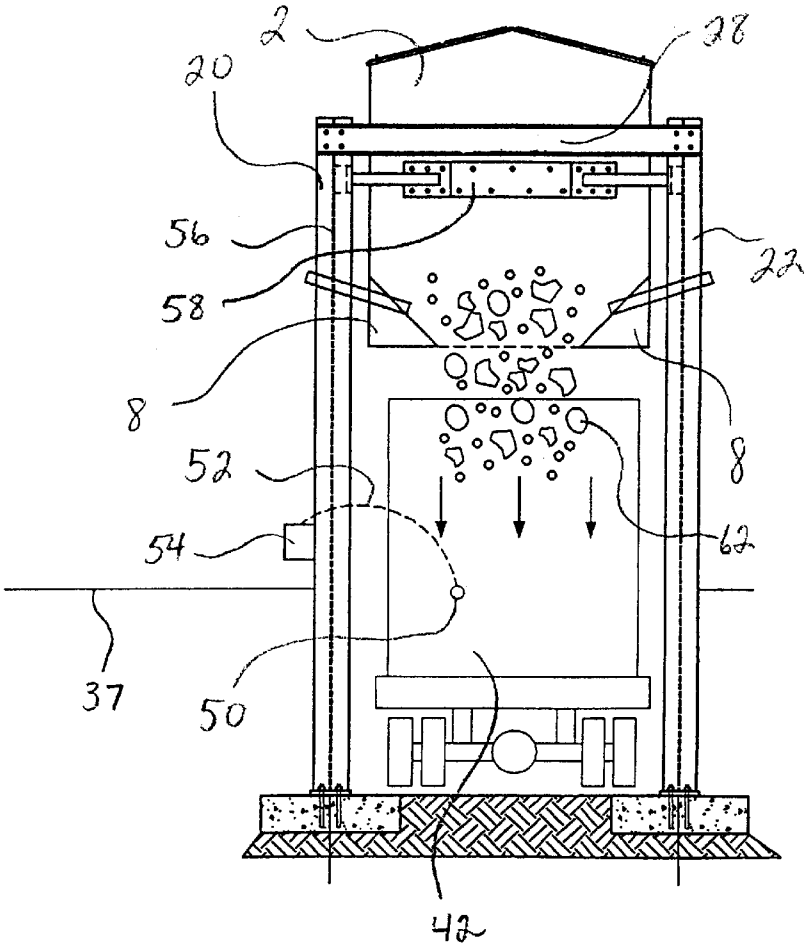
Figure 7:
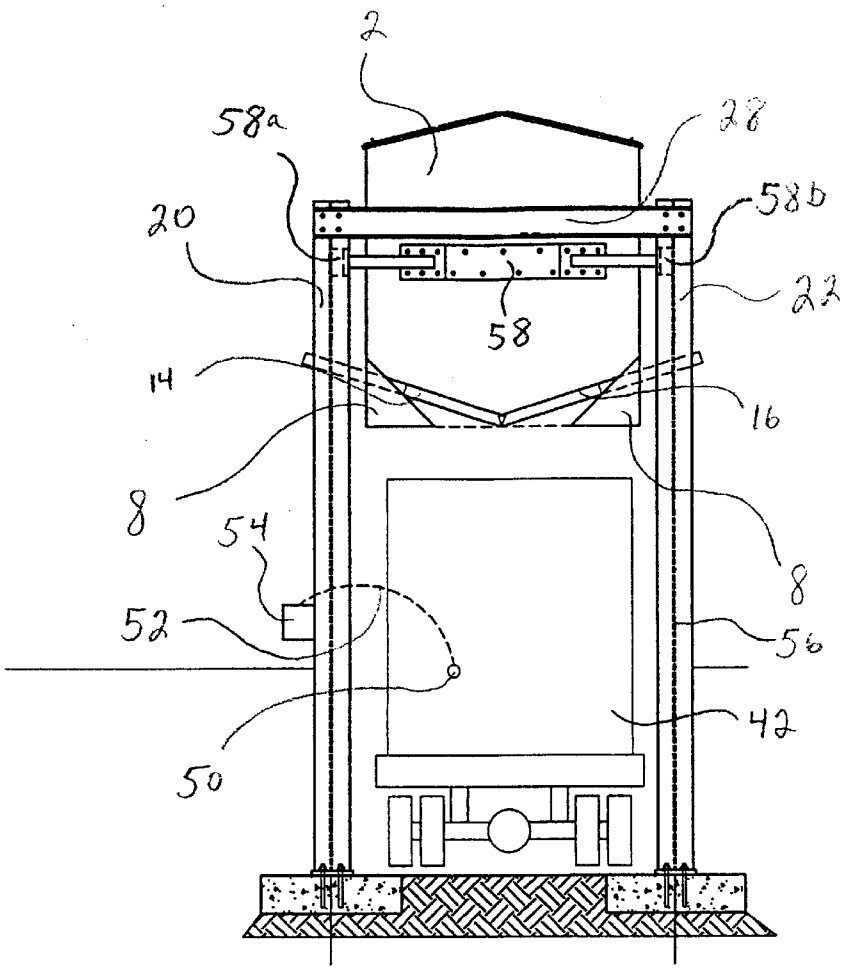
Figure 10:
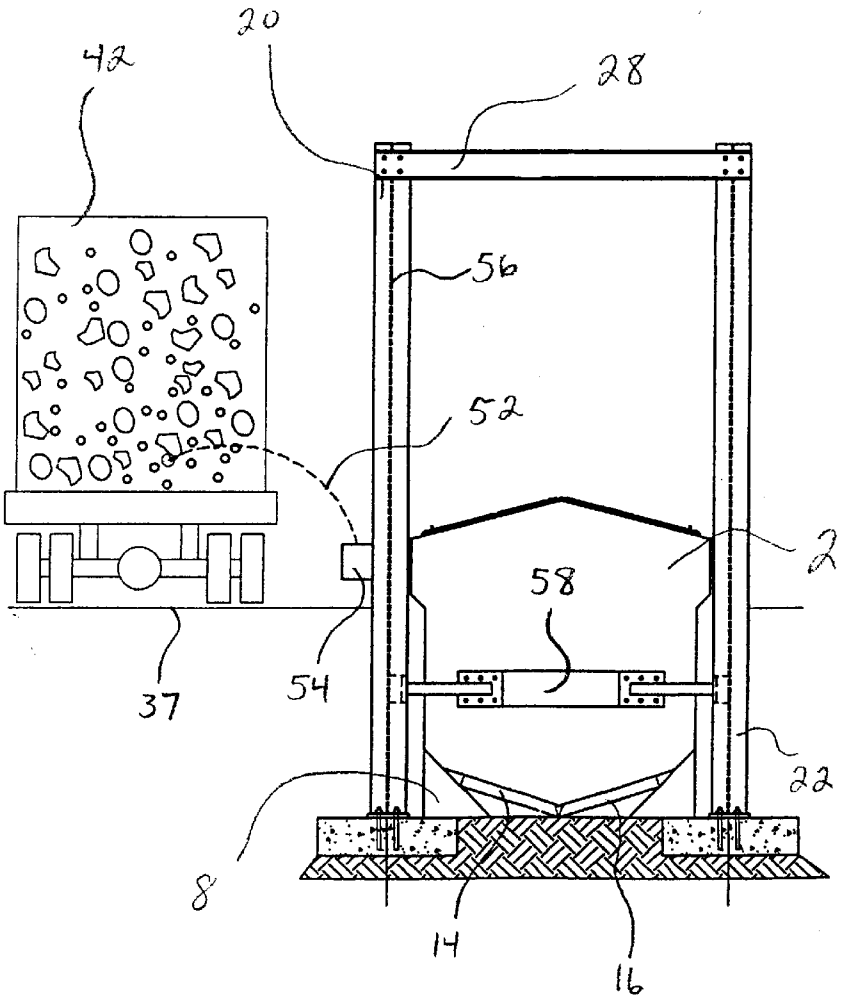
Figure 9:
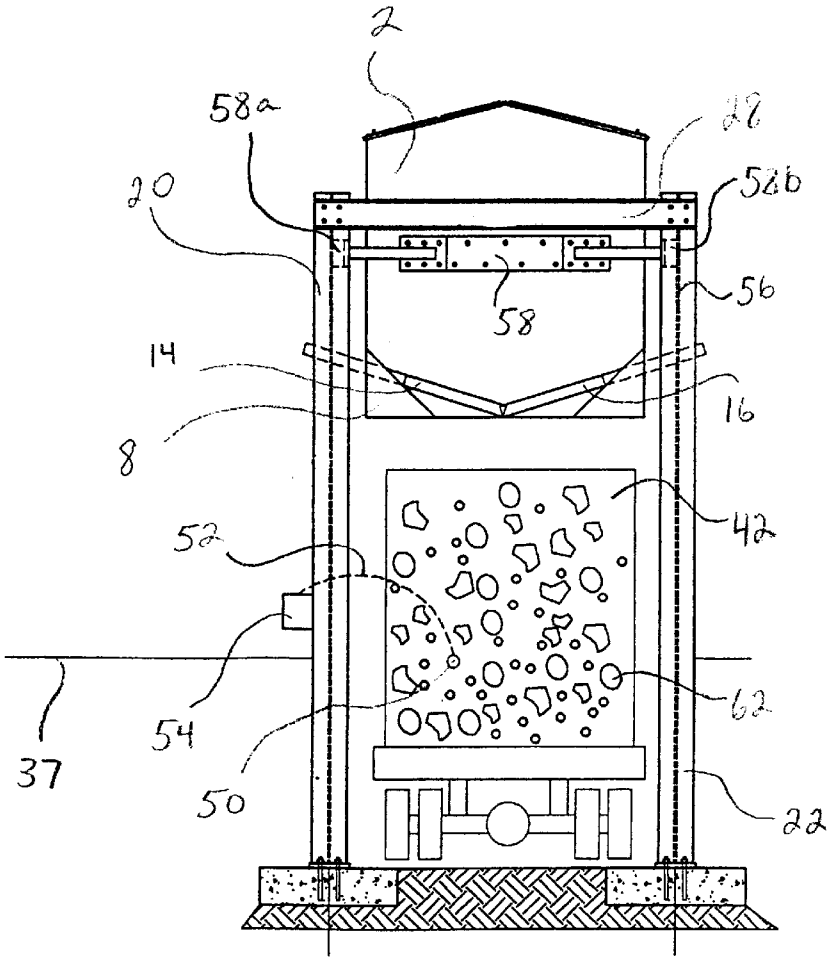

Doors 14 and 16 are retractable from their closed position of FIG. 7 to their open position of FIG. 8 via hydraulic system 50 of truck 42 and linkage 52 thereof with control panel 54. The retracted, or "open", position of doors 14, 16 is shown in dotted outline in FIGS. 6, 7 and 9. Side walls 2*a* and 2*b* of container 2 have slots 14*a* and 16*a* to accommodate the retraction of doors 14, 16 (see FIG. 6). As seen in FIG. 5, when container 2 is in its first, lowered position, slots 14*a* and 16*a* are below ground level 37. Doors 14, 16 may overlap slightly in their closed position to provide increased strength. Retractable doors 14, 16 allow for the regulation of the amount of refuse 62 to be dumped from raised container 2. Truck 42 need not always be empty to accept refuse 62, but could instead be partially filled with refuse from a stop at a previous collection site. In such circumstances, it may not be possible for truck 42 to accept all of refuse 62 from container 2. Rather than tilting the collection container and fully dumping its contents, as was done in the prior art, it is possible to slightly retract doors 14, 16 to define a less-than-full opening therebetween, thus controlling the amount of refuse transferred from container 2 to truck 42. Once truck 42 is filled, doors 14, 16 can be closed and spillage is prevented. Truck 42 can then drive up exit 48 and haul away a full load of refuse. Apparatus 10 thus allows transportation trucks to run with 100% haul efficiency, while maintaining a clean collection site at the same time.

Additionally, the retractable door arrangement of container 2 is preferred over a "swinging" door arrangement because such swing doors can become lodged within truck 42 or between truck 42 and beams 20, 22, 24 or 26, thereby requiring human attention to remedy the situation. Not only is such a remedial procedure time-consuming, but it is potentially dangerous to for persons to be under raised container 2 for extended periods of time.

As mentioned, truck 42 departs from under container 2 via sloped exit 48. Before commencing the haul, however, linkage 52 is once again re-established so that container 2 is returned to its usual position (FIG. 10) so that it is capable of receiving "new" refuse.

It may be desirable to include a drainage system to prevent moisture accumulation underneath container 2. Such a drainage system could take the form of specialized drain tile installed underneath container 2 to funnel moisture to a drain pipe leading directly to a septic tank. Alternatively, an arrangement could be employed whereby a hose, powered by hydraulic system 50 of truck 42, is used to draw off any accumulated moisture. The accumulated moisture could then be taken to an appropriate disposal location, such as a septic tank.

As will be apparent to those skilled in the art in the light of the foregoing disclosure, many alterations and modifications are possible in the practice of this invention without departing from the spirit or scope thereof. For example, apparatus 10 has been described herein as utilizing hydraulic system 50 of truck 42 to raise and lower container 2. This has been done to take advantage of the existing hydraulic system 50 on transportation truck 42. One could also envision an arrangement whereby the whole of the hydraulic system for raising and lowering container 2 is self-contained to apparatus 10. This might be necessary, for example, if hydraulic system 50 was ineffective, for whatever reason, to raise full container 2. Alternatively, it would also be possible for the raising and lowering of container 2 to be powered by an electric source, which may or may not be internal to apparatus 10.

Similarly, the raising and lowering of container 2, as described herein, has been effected through the combination of hydraulics and cables 56. It will be appreciated by those skilled in the art that any suitable means of raising and lowering of container 2 to the desired elevations, while still allowing access for truck 42 underneath raised container 2, would fall within the inventive scope of this invention. For example, one could envision utilizing rods or cylinders (telescoping or otherwise) underneath the periphery of container 2 to effect the movement of container 2. In such an arrangement, the cylinders would have to be spaced apart a distance greater than the width of truck 42 to enable truck 42 to driver underneath container 2 when container 2 is in its raised position.

Similarly, it will be appreciated that it is not absolutely necessary for collection and transfer apparatus 10 to be partially below-ground level 37. Instead, it is within the inventive scope herein to alternatively provide apparatus 10 at ground level and adjust the height of beams 20, 22, 24 and 26 accordingly to accommodate the height of truck 42.

Similarly, the apparatus of the present invention need not be limited to one refuse collection and transfer container. It is within the inventive scope herein defined that apparatus 10 could be adapted to have side-by-side containers, each movable independent of the other, so that refuse 62 could be segregated, if necessary. For example, it may be desirable to provide a container to collected recyclables, such as cardboard or newspapers, separate from ordinary household garbage.

Accordingly, the scope of the invention is to be construed in accordance with the substance defined by the following claims.

What is claimed is:

1. An apparatus for collecting and transferring refuse to a transportation truck, said apparatus comprising a refuse collection and transfer container having opposing side walls, exterior corners, and two bottom doors extending substantially the length of said side walls, said doors being downwardly and inwardly angled from said side walls so as to converge at the bottom of said refuse collection and transfer container thereby forming a closed position, said bottom doors being retractable to an open position from said closed position through slots in said side walls, said container movable between a first, lowered position and a second, raised position high enough above said first position to allow said transportation truck underneath said refuse collection and transfer container, wherein when said refuse collection and transfer container is in said second position and said bottom doors are retracted to said open position, said refuse is transferred from said refuse collection and transfer container to said transportation truck.

2. The apparatus of claim 1 wherein said bottom doors are linked to a hydraulic system of said transportation truck, the movement of said bottom doors between said open and closed positions being powered by said hydraulic system.

3. The apparatus of claim further comprising:

(a) four upright beams positioned proximate to the exterior corners of said refuse collection and transfer container, each of said upright beams including a cable movable relative to said beam; and (b) at least two container braces connecting said refuse collection and transfer container to said cables;

wherein vertical movement of said cables causes said movement of said refuse collection and transfer container between said first and second positions.

4. The apparatus of claim 3 wherein said cables are linked to said hydraulic system, said movement of said cables being powered by said hydraulic system.

5. The apparatus of claim 4 wherein when said refuse collection and transfer container is in said first position a lower portion of said refuse collection and transfer container, including said slots in said side walls, is below ground level.

6. The apparatus of claim 5 further comprising two retaining walls, said retaining walls being substantially below ground level, adjacent to said refuse collection and transfer container and extending the length of said refuse collection and transfer container.

7. The apparatus of claim 4 wherein said retaining walls extend past said upright beams and adjacent to a sloped entrance for accepting said transportation truck at one end of said refuse collection and transfer container and a sloped exit for allowing said transportation truck to exit at a second end of said refuse collection and transfer container.

8. The apparatus of claim 7 wherein the bottom interior corners of said container are downwardly and inwardly angled.

9. The apparatus of claim 8 wherein said container has a roof and at least one door for receiving said refuse, said at least one door being in one of said side walls or in the roof of said collection and transfer container.

10. The apparatus of claim 4 further comprising a control panel for controlling the movement of said bottom doors and said cables, said control panel linked to said bottom doors and said cables and capable of being linked to said hydraulic system.

11. A method of collecting and transferring refuse to a transportation truck, said method comprising the steps of:

(a) providing an apparatus for collecting and transferring refuse to a transportation truck, said apparatus comprising a refuse collection and transfer container movable between a first, lowered position and a second, raised position, said second position being high enough above said first position to allow said transportation truck underneath said refuse collection and transfer container, solid refuse collection and transfer container having bottom doors, exterior corners, a roof, and at least one door for receiving said refuse, said door for receiving refuse being in one of two opposite side walls or in the roof of said refuse collection and transfer container; said apparatus further having (i) four upright beams positioned proximate to the exterior corners of said refuse collection and transfer container, each of said upright beams including a cable movable relative to said beam;

(ii) at least two container braces connecting said refuse collect on and transfer container to said cables; and (iii) a control panel linked to said cables and said bottom doors and capable of being linked to a hydraulic system of said transportation truck;

(b) collecting refuse in said refuse collection and transfer container when said container is in said first position;

(c) raising said refuse collection and transfer container to said second position;

(d) driving said transportation truck underneath said raised refuse collection and transfer container;

(e) opening said bottom doors of said refuse collection and transfer container so that said refuse collected in said refuse collection and transfer container is transferred to said transportation truck;

(f) closing said bottom doors after at least some of said refuse has been transferred to said transportation truck;

(g) driving said transportation truck from underneath said raised refuse collection and transfer container; and (h) lowering said refuse collection and transfer container to said first position.

12. The method of claim 11 wherein step (c) comprises:

(i) driving said transportation truck to a location proximate to said apparatus;

(ii) establishing a linkage between said hydraulic system, said cables and said control panel when said refuse collection and transfer container is in said first position; and (iii) using said control panel to move said cables with said hydraulic system to raise said refuse collection and transfer container to said second position.

13. The method of claim 12 wherein said step (e) comprises:

(i) establishing a linkage between said hydraulic system, said bottom doors and said control panel; and (ii) using said control panel to open said bottom doors with said hydraulic system so that said refuse collected in said refuse collection and transfer container is transferred to said transportation truck.

14. The method of claim 13 wherein said step (f) comprises using said control panel to close said bottom doors with said hydraulic system.

15. The method of claim 14 wherein said step (g) comprises:

(i) disconnecting said linkage between said hydraulic system and said bottom doors; and (ii) exiting said transportation truck from underneath said raised refuse collection and transfer container.

16. The method of claim 15 wherein said step (h) comprises:

(i) driving said transportation truck to a location proximate to said apparatus;

(ii) establishing a linkage between said hydraulic system, said cables and said control panel when said refuse collection and transfer container is in said second position; and (iii) using said control panel to move said cables with said hydraulic system to lower said refuse collection and transfer container to said first position; and (iv) disconnecting said linkage between said hydraulic system, said cables and said control panel.

* * * * *